US006794984B2

(12) United States Patent
Komatsu

(10) Patent No.: US 6,794,984 B2
(45) Date of Patent: Sep. 21, 2004

(54) SLIDING-TYPE ELECTRIC COMPONENT HAVING CARBON FIBER CONTACT

(75) Inventor: Hisashi Komatsu, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 10/461,166

(22) Filed: Jun. 13, 2003

(65) Prior Publication Data

US 2004/0000984 A1 Jan. 1, 2004

(30) Foreign Application Priority Data

Jun. 26, 2002 (JP) ..... 2002-186736

(51) Int. Cl.[7] ..... H01C 1/12
(52) U.S. Cl. ..... 338/202; 338/160; 338/118
(58) Field of Search ..... 338/202, 118, 338/160, 162

(56) References Cited

U.S. PATENT DOCUMENTS 4,045,765 A * 8/1977 Imamura ..... 338/176
4,261,099 A 4/1981 Gainer, Jr.
4,306,169 A * 12/1981 Diepers ..... 310/248
4,345,236 A * 8/1982 Eichelberger et al. ..... 338/176
4,361,775 A * 11/1982 Diepers et al. ..... 310/248
4,415,635 A * 11/1983 Wilsdorf et al. ..... 428/611
5,554,965 A * 9/1996 Sundberg ..... 338/160
5,843,567 A * 12/1998 Swift et al. ..... 428/221
5,885,683 A 3/1999 Swift
6,140,907 A 10/2000 Liu
6,214,921 B1 * 4/2001 Bluett et al. ..... 524/495
6,392,529 B1 5/2002 Liu
6,414,584 B1 7/2002 Liu et al.
6,444,102 B1 9/2002 Tucci et al.

FOREIGN PATENT DOCUMENTS

DE 3911100 A1 10/1990
JP 1-207902 * 8/1989 ..... 338/75
JP 2533522 1/1997

* cited by examiner

*Primary Examiner*—Karl D. Easthom
(74) *Attorney, Agent, or Firm*—Beyer Weaver & Thomas, LLP

(57) ABSTRACT

The present invention provides a sliding contact member including a contact element, wherein the contact element includes a bundle of carbon fibers formed by bundling a plurality of carbon fibers and lubricant contained among the plurality of carbon fibers of the bundle of carbon fibers, and at least part of the bundle of carbon fibers is capable of a sliding movement with respect to tracks of a conductive pattern.

6 Claims, 7 Drawing Sheets

SLIDING-TYPE ELECTRIC COMPONENT HAVING CARBON FIBER CONTACT

BACKGROUND OF THE INVENTION

1. Field of the Invention

The present invention relates to a sliding-type electric component, which are used for a potentiometer or the like of an automotive vehicle, and to a technology to enable reduction of conductive resistance in a conducting route and provision of highly reliable products.

2. Description of the Related Art

Hitherto, as shown in FIG. 15, a variable resistor having a sliding contact member including a slider 105 slidably provided along a guide rod 108 within a laterally elongated casing 100 having a slit 100*a* on its top plate, a resistance board 103 having a resistive element 102 patterned on the surface thereof below the slider 105, a sliding element 104 provided on the bottom of the slider 105 so as to slide with respect to the resistive element 102 during operation, an operating lever 105*a* formed on top of the slider 105 so as to project from the slit 100*a,* and a pair of coil springs 106, 107, being formed of shape memory alloy, provided at both ends of the guide rod 108 for clamping the slider 105 in a state of being abutted against stoppers 110, 110 is known.

In the variable resistor in this structure, reciprocal movement of the slider 105 along the guide rod 108 causes the sliding element 104 to slide while keeping in contact with the resistive element 102. However, since an extremity 104*a* of the sliding element 104 rubs the surface of the resistive element 102, a stable sliding movement of the sliding element 104 is achieved by, for smooth sliding movement, providing a grease trap 109 on one side of the resistance board 103, allowing the coil springs 106, 107, which deform into a predetermined shape at a predetermined temperature, to cause the extremity 104*a* of the sliding element 104 to pass through the grease trap 109 and get grease attached thereon, and supplying attached grease over the surface of the resistive element 102.

However, in the variable resistor in the construction shown in FIG. 15, there are problems in that supply of grease in the case where the variable resistor is inclined is liable to be unstable, and in that supply of grease may further be unstable in the case in which the variable resistor is subjected to repetitive vibrations in the inclined state. In addition, since the coil springs 106, 107 must be provided on both sides of the slider 105, and the coil springs are expensive, the cost of components tend to increase. Furthermore, although a metallic press member is employed as the sliding element 104 in the construction shown in FIG. 15, there are problems in that the metallic sliding element 104 is liable to generate noise when sliding with respect to the resistive element 102, and in that the surface of the resistive element 102 tends to be worn easily due to the repetitive sliding movement, and thus ground powder may easily be generated in the area around the sliding contact member.

SUMMARY OF THE INVENTION

In view of such circumstanced, one object of the invention is to provide a sliding-type electric component in which lubricant, such as grease, can definitely be contained, supply of lubricant can automatically be made, wear thereof at the contact point is reduced, generation of sliding noise is reduced, and possibility to grind a track of a conductive pattern with respect to which the sliding contact member slides and thus to generate ground powder is reduced, and to provide a sliding-type electric component and a sensor.

In order to solve the problem described above, a sliding-type electric component of the invention includes a contact element, and is characterized in that the contact element includes a bundle of carbon fibers formed by bundling a plurality of carbon fibers and lubricant contained among the plurality of carbon fibers of the bundle of carbon fibers, and at least part of the bundle of carbon fibers is capable of a sliding movement with respect to a track of a conductive pattern.

Lubricant is contained among the bundled carbon fibers of the bundle of the carbon fibers. The lubricant is automatically supplied to a sliding portion of the bundle of carbon fibers, which slides with respect to a separate member.

According to the invention, preferably, the bundle of carbon fibers is constructed in such a manner that each carbon fiber extends toward a contact point, which is formed on a part of the bundle of carbon fibers, and lubricant contained among the plurality of carbon fibers is held along the length of the carbon fibers so as to be supplied freely to the contact point.

Since the bundle of carbon fibers slide with respect to the track of the conductive pattern while supplying lubricant according to the invention, possibility to grind the track is reduced in comparison with a case in which the carbon fibers are simply slid, and thus the track is hardly ground, thereby slowing progress of wear of the track. Therefore, when the track is subjected to the repetitive reciprocating sliding movement, sliding characteristic of the contact element with respect to the track becomes stable, and thus withstanding long term of use.

The track of the conductive pattern applied herein may be any of a layer of resistive element, a layer of conductive element, a collector layer, and a metallic layer, and may be a lamination layer of the same.

In the sliding contact member according to the invention, an embracing member for partly surrounding the bundle of carbon fibers and supporting the bundle of carbon fibers is provided, and the carbon fibers constituting the bundle of carbon fibers are held in close contact with each other by the embracing member.

When the carbon fibers of the bundle of carbon fibers are held in close contact with each other, gaps among the carbon fibers may be reduced in the area held by the embracing member or the area not held by the embracing member. Therefore, lubricant can easily be contained in the gaps among the carbon fibers. Even when the lubricant is liquid such as lubricating oil, when the carbon fibers of the bundle of the carbon fibers are closely bundled, the lubricant can be held sufficiently by surface tension, and thus it can be held among the carbon fibers without problem even when the lubricant is grease or the like.

In order to solve the above-described problem, the sliding contact member according to the invention is characterized in that the embracing member for partly embracing and supporting the bundle of carbon fibers is provided, the carbon fibers constituting the bundle of carbon fibers are held in close contact with each other by the embracing member, and lubricant is contained internally of the embracing member.

Since the carbon fibers are held closely by the embracing member, the respective carbon fibers are held in close contact with each other, and lubricant is contained internally of the embracing member. Therefore, supply of lubricant can be held stably for a long time.

In order to solve the above-described problem, the present invention is characterized in that the embracing member is formed of metallic material formed so as to clamp at least part of the bundle of carbon fibers.

Since the bundle of carbon fibers is held so as to clamp by the metallic material, the carbon fibers can be held in further close contact.

DESCRIPTION OF THE PREFERRED EMBODIMENTS

Figure 1:
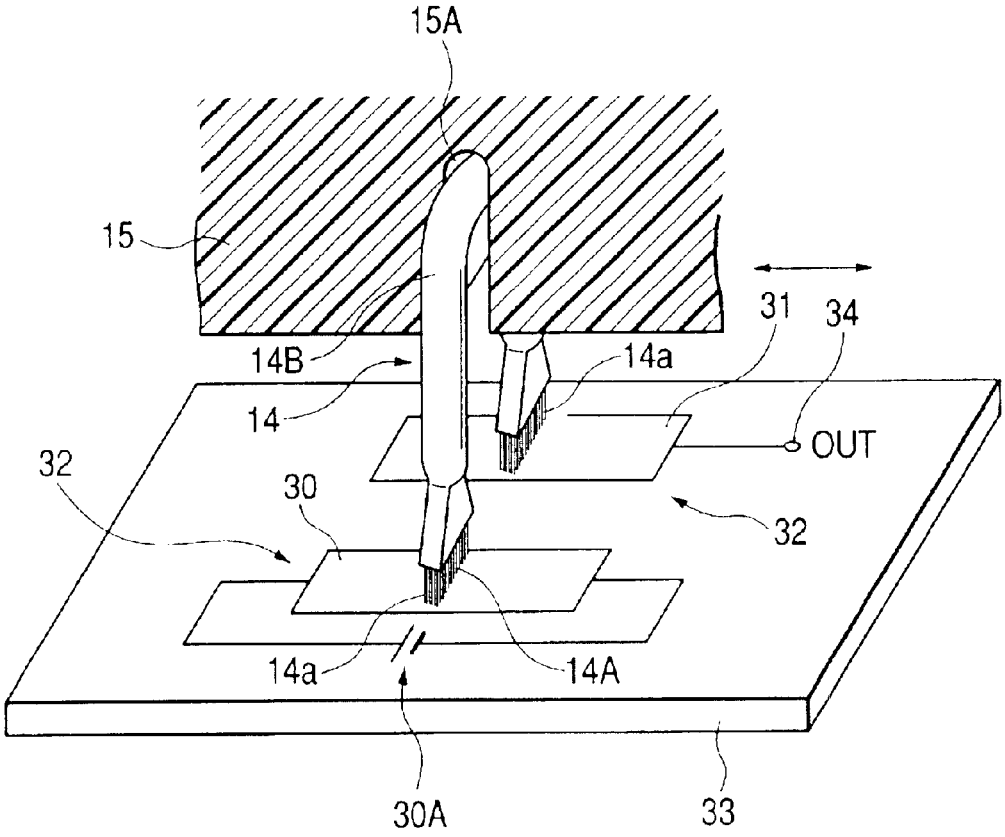
FIG. 1 is a perspective view showing a positional relationship between a sliding contact member with respect to a first track and a second track according to a first embodiment of the invention.

Referring now to the drawings, embodiments of the invention will be described. However, the invention is not limited to the following embodiments.

In FIG. 1, reference numeral 15 designates a sliding element support (supporting member) provided so as to be capable of reciprocating movement in the lateral direction in FIG. 1, which is formed with a recess 15A extending diagonally on the bottom of the sliding element support 15. A sliding contact member 14, which will be described later in detail, is attached to the recess 15A by fixing means such as adhesion or the like.

The sliding contact member 14 in this embodiment includes a bundle of carbon fibers 14A bent into a U-shape (bifurcated) as will be described later, a holding member (embracing member) 14B formed into a U-shaped cylinder for constraining the bundle of carbon fibers 14A, and lubricant such as grease contained in the holding member 14B. The bundle of carbon fibers 14A bifurcated into a U-shape serves as the contact element (sliding element).

The bundle of carbon fibers (contact element) 14A is formed by bundling, preferably, hundreds to thousands, for example, one thousand to two thousands of thin carbon fibers of several to several tens of micro meter, for example, in the order of 5 to 10 $\mu$m in diameter. The bundle of carbon fibers is bent into a U-shape, and the U-shape is maintained by the U-shaped holding member 14B formed of a metallic pipe that is capable of plastic deformation, such as an aluminum pipe, a brass pipe, or a stainless steel pipe, and both ends on the side opposite from the bent section, that is, ends 14*a,* 14*a* of the bundle of carbon fibers 14A, project from both ends of the holding member 14B by a predetermined length as sliding ends.

Lubricant may be any of olefin lubricant, silicone lubricant, fluorinated lubricant, and mineral lubricant, and as a matter of course, may be some other lubricants such as semi-solid lubricant obtained by adding thickening material to the lubricant. Among the above-described types of lubricant, the fluorinated one is high in heat resistance and is hardly evaporated, and thus has a feature that can easily eliminate ground powder when the ground powder is present on the sliding surface on the track.

The both ends of the holding member 14B, which is formed of the aluminum pipe or the like, are formed into a flat shape 14*b* by press work or the like for preventing the carbon fibers from coming off and shaping the contour of the carbon fibers. The ends 14*a,* 14*a,* which serve as sliding portions of the carbon fibers exposed from these flat portions 14*b,* project in alignment into a flat shape, respectively, so that the extremities of the carbon fibers projected independently at one end 14*a* and the other end 14*a* are disposed in parallel so as to be aligned in substantially the same plane.

In this example, since the flat portions 14*b* are formed by plastically forming the both ends of the metallic pipe by pressing means such as a press into a flat shape so that the carbon fibers are aligned into a flat shape, the both ends of the holding member 14B are broadened toward the ends during processing. However, the invention is not limited to this shape, and the both ends do not have to be processed into a flat shape, as a matter of course.

The sliding contact member 14 formed as described above is inserted into the recess 15A formed on the bottom side of the sliding element support 15 by about a half the length of the holding member 14B. The inserted portion is fixed to the recess 15A by fixing means such as adhesion, and is fixed to the bottom of the sliding element support 15 in a state in which the extremities of the ends 14*a,* 14*a* of the sliding contact member 14 are slightly projected from the bottom of the sliding element support 15.

A conductive pattern 32 including a pair of first track 30 and a second track 31, each being a rectangular shape and arranged in parallel, is formed on a base member 33 such as a substrate downwardly of the sliding element support 15, that is, at the position facing the ends 14*a,* 14*a* at the extremities of the sliding contact member 14. The shape of the track in plan view may be any shape as long as the contact element can slide thereon, such as a rectangular shape, a comb shape, an arcuate shape, or a rectangular wave shape.

The ends 14*a,* 14*a* of the sliding contact member 14 are disposed so as to straddle widthwise of the first track 30 and the second track 31 on the base member 33 in substantially parallel with each other. In other words, one end 14*a* of the bundle of carbon fibers 14A, which is flat in shape and the other end 14*a* of the bundle of carbon fibers 14A are supported so as to keep in contact to, and slide along, the length of the tracks, respectively, in a state in which the width of one end 14*a* is aligned with the width of the first track 30, and the width of the other end 14*a* is aligned with the width of the second track 31.

Therefore, the sliding contact member 14, the first track 30, and the second track 31 constitute the sliding-type electric component, and the first track 30 and the bundle of carbon fibers 14A, and the second track 31 constitute the conducting route (electric path). In this conducting route, the contact elements exist as sliding portions at two positions, that is, extremities of the ends 14*a,* 14*a* of the bundle of carbon fibers 14A. A predetermined direct current is applied on the first track 30 from a predetermined power unit 30A, and an output terminal 34 is formed at one end of the second track 31.

The first track 30 is formed of a resistive element constructed, for example, of a conductive element, such as carbon black or carbon fiber, and carbon nanotube, which mainly reinforces the layer of resistive element and reduces its coefficient of friction, and a polymer resistive element formed of thermoset resin, such as phenol resin or epoxy resin. The second track 31 is formed of a good conductor, for example, a conductive circuit formed by mixing conductive metallic material, such as copper foil, aluminum foil, and the like, or a conductive element, such as silver powder, into a thermoset resin, so as to serve as a collector. The layer of resistive element is formed by transfer printing or the like so as to obtain the roughness of the surface of 0.5 $\mu$m or below. Therefore, since the carbon fibers are less caught by the surface, hysteresis that may be occur during reciprocal movement may further be prevented.

The carbon black may be furnace black having relatively low conductivity (for example, ASAHI 60 from ASAHI CARBON Co., Ltd., RAVEN 150 from Columbian Chemicals Company, MA 100 from Mitsubishi Kasei KK). The carbon black may be conductive furnace black having relatively high conductivity (for example, KETJEN BLACK EC from LION CORPORATION), or acetylene black (for example DENKA BLACK from DENKI KAGAKU KOGYO KABUSHIKI KAISHA).

According to the sliding-type electric component constructed as described above, the sliding element support 15 reciprocally moves in parallel with the tracks 30, 31 in the lateral direction in FIG. 1. Therefore, the side portions 14*a,* 14*a* of the sliding contact member 14 slide reciprocally with respect to the first track 30 and the second track 31, and an input voltage applied on the first track 30 is divided depending on the position of the sliding contact member 14 during the sliding movement, more accurately, the position of the ends 14*a,* 14*a,* which are brought into contact with the tracks 30, 31. Then, the position of the ends 14*a* of the sliding contact 14 is detected by measuring the output voltage, so that the position can be detected from the relative relationship between the output voltage and the position. The output voltage may be obtained by measuring the electric output from the output terminal 34 connected to the second track 31.

During sliding movement described above, since the bundle of carbon fibers 14A is impregnated with lubricant, smooth sliding movement is achieved as a result that the lubricant is supplied to the contact portions at the extremities of the carbon fibers during sliding movement. Consequently, there is no possibility that the extremities of the carbon fibers grind the tracks 30, 31, and thus generation of ground powder during sliding movement is eliminated, thereby improving life span in terms of sliding movement. In addition, since the extremities of the bundle of carbon fibers 14A are brought into contact with the tracks 30, 31 at a number of ends of the carbon fibers, sliding noise may be reduced.

In the sliding-type electric component having the construction described above, the pair of tracks 30, 31 can be electrically connected reliably mainly via the bundle of carbon fibers 14A.

In addition, since the two tracks 30, 31 can be electrically connected reliably mainly via the bundle of carbon fiber 14A, it is not necessary to perceive electric signals directly from the carbon fibers, and the electric signals can be perceived directly from the tracks 30, 31.

The bundle of carbon fibers 14A constructed as described above according to FIG. 3 to FIG. 5 may be fabricated, for example, by a method described below.

Figure 3:
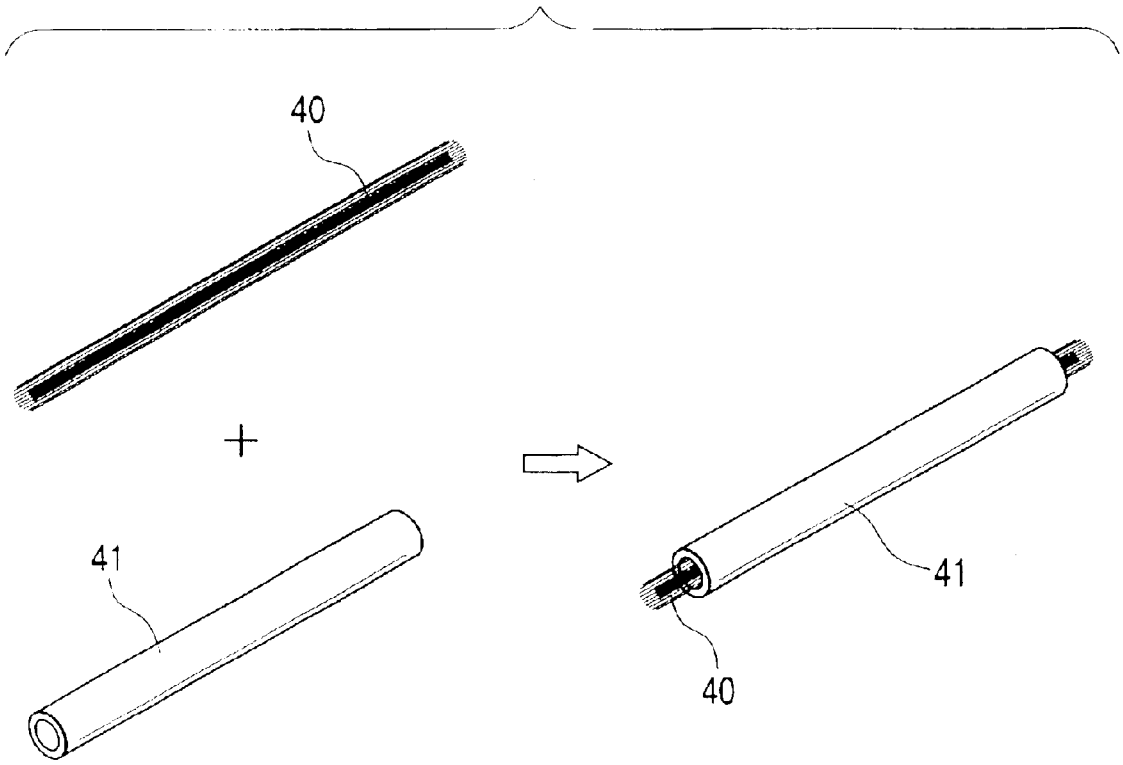
FIG. 3 is an explanatory perspective view illustrating a method of assembly of the sliding contact member.

As shown in FIG. 3, when the required number of, for example, 1000 to 2000, carbon fibers 40 cut into a required length are bundled, and the bundled carbon fibers 40 are inserted through an aluminum pipe 41. Then, the bundle of carbon fibers may be impregnated with lubricant between the bundle of carbon fibers by soaking into lubricant, or if semi-solid lubricant, such as grease, is used, the semi-solid lubricant is applied on the bundle of carbon fibers so as to be held among the bundle of carbon fibers. Alternatively, the bundle of carbon fibers may be inserted after semi-solid lubricant, such as grease, is stuffed in the pipe 41 in advance.

Figure 4:
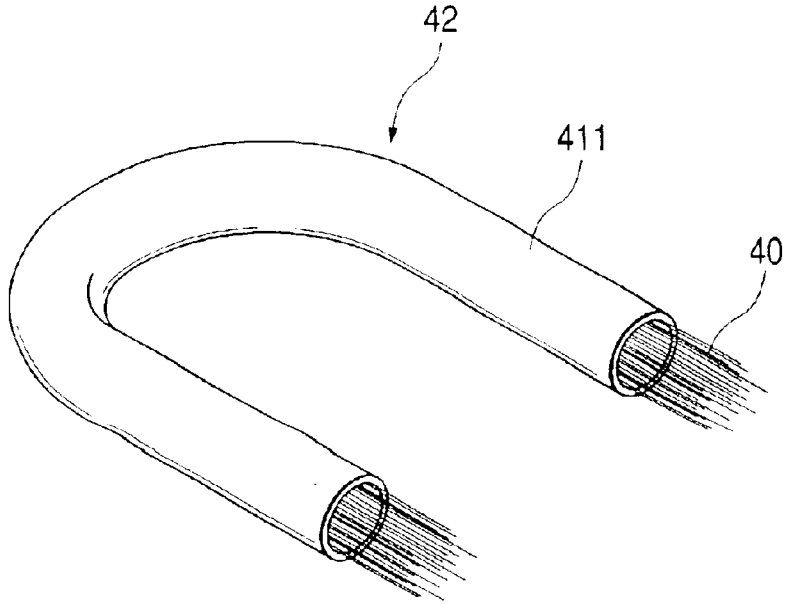
FIG. 4 is a perspective view of an intermediate compact obtained in the process of assembling the sliding contact member.

Then, as shown in FIG. 4, the pipe 41 is plastically deformed into a U-shape by bending work to obtain a U-shape tube 411, and an intermediate compact 42 in which the bundle of carbon fibers 40 is held into the U-shape.

Figure 2:
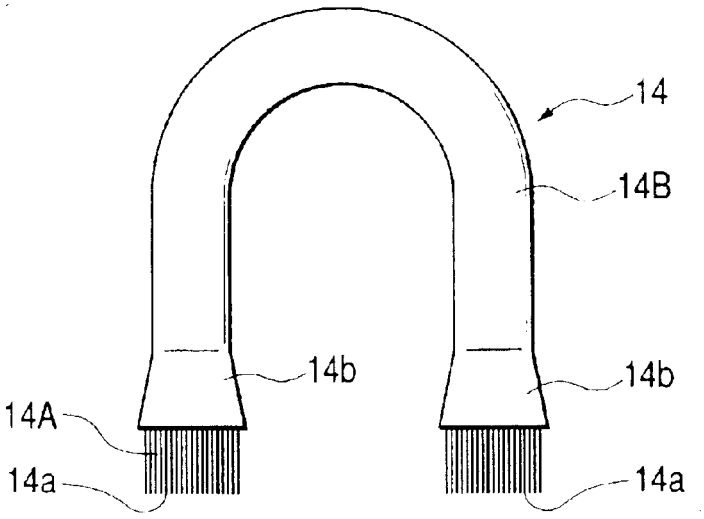
FIG. 2 is a plan view of the sliding contact member.
Figure 5:
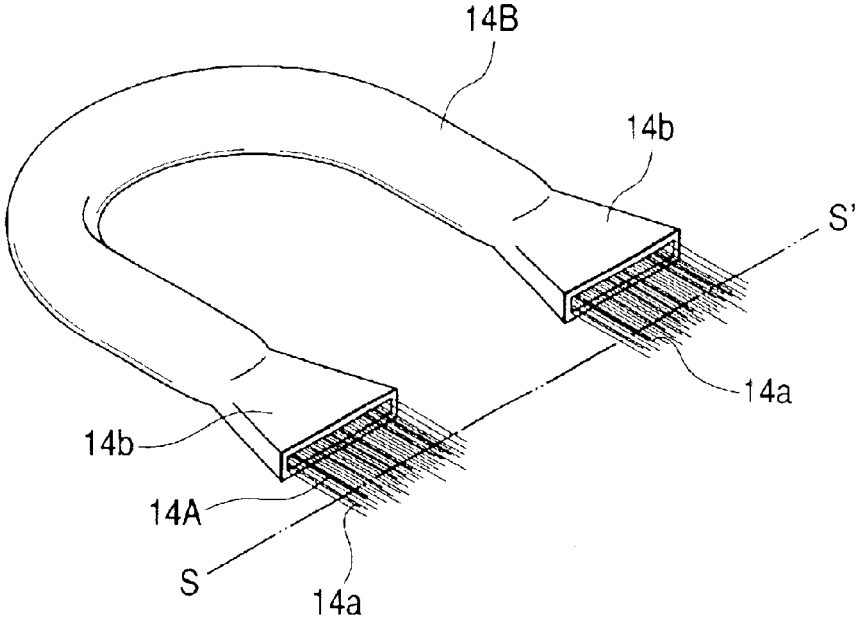
FIG. 5 is a perspective view showing the sliding contact member in the last stage of the processing.

Subsequently, the ends of the U-shape tube 411 are plastically deformed into a flat shape by press work, so that the lubricated U-shaped bundle of carbon fibers in a state of being constrained by the holding member 14B including flat portions 14*b* as shown in FIG. 5 is obtained. When the extremities of the carbon fibers projected from the pipe 41 are not aligned, the extremities of the carbon fibers may be cut along a cutting line S–S' shown by a chain double-dashed line in FIG. 5 to obtain the bundle of carbon fibers (sliding contact member) 14A shown in FIG. 2.

In this embodiment, by bending the holding member, the carbon fibers are prevented from being come off easily in comparison with the straight shape.

Figure 6:
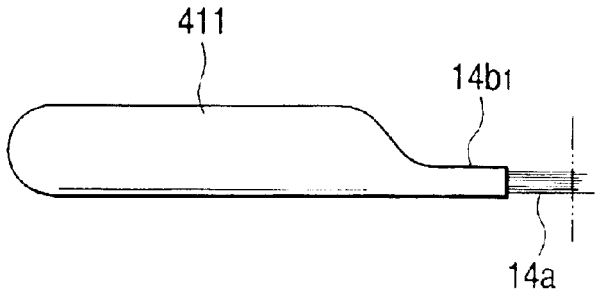
FIG. 6 is a side view showing an example of the shape of the end of the sliding contact member according to the invention.
Figure 7:
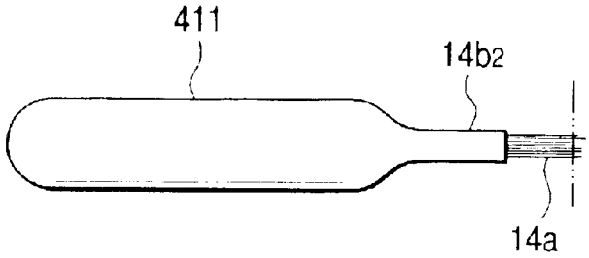
FIG. 7 is a side view showing another example of the shape of the end of the contact element according to the invention.

When forming the flat portions 14*b* by plastically deforming the U-shaped tube 411 shown in FIG. 4 by press work, the U-shaped tube 411 may be pressurized mainly by the press from one side in the direction of thickness of the U-shaped tube 411 to form a flat portion 14*b*1 at the bottom side of the U-shaped tube 411 in the direction of thickness as shown in FIG. 6, or the U-shaped tube 411 may be pressurized from both sides in the direction of thickness to form a flat portion 14*b*2 at the center in the direction of thickness of the U-shaped tube 411 as shown in FIG. 7. The ends of the bundle of the carbon fibers 14A after press work are preferably cut along the cutting line shown by a chain double dashed line to obtain a uniform length of projection in both cases shown in FIG. 6 and FIG. 7.

Figure 8:
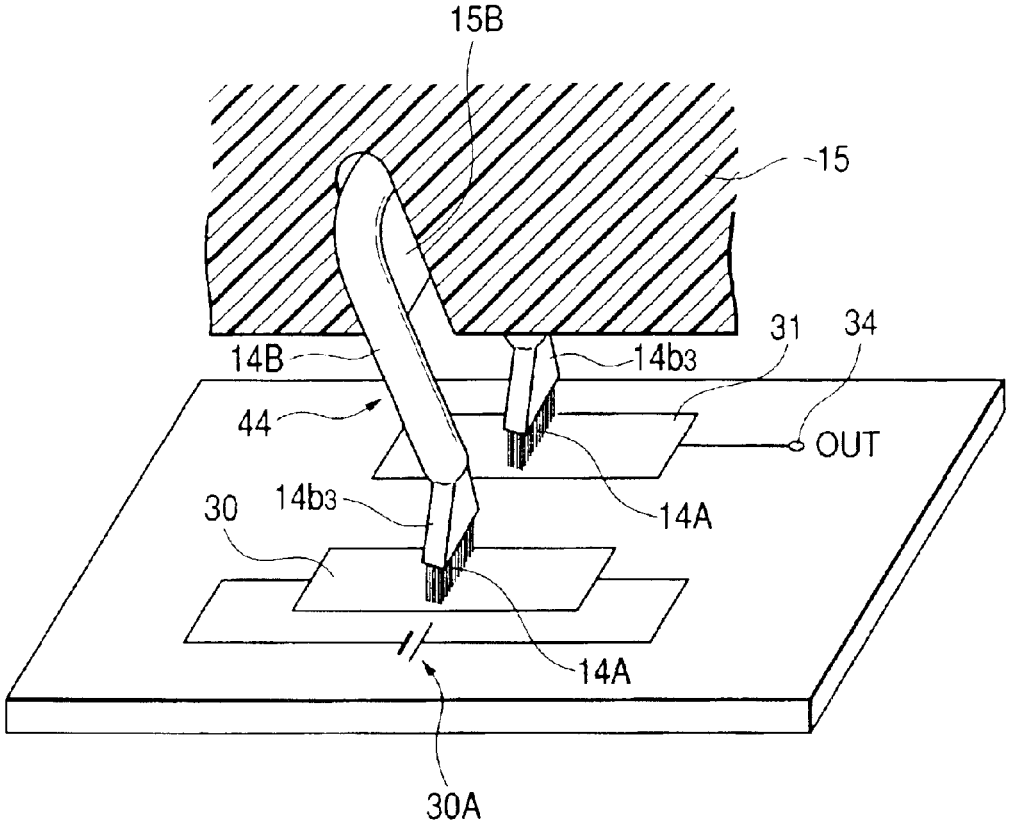
FIG. 8 is a perspective view showing a positional relationship between the sliding contact member with respect to the first track and the second track according to a second embodiment of the invention.

FIG. 8 shows a second embodiment of the sliding contact member according to the invention. In this embodiment, a recess 15B, which is opened diagonally downward, is formed on the sliding element support (supporting member) 15, and the U-shaped holding member 14B is fixed to the recess 15B so as to face diagonally downward by fixing means such as adhesion or the like. A sliding contact member 44 constructed in such a manner that a flat portion 14*b*3 of the holding member 14 is downwardly bent is fixed, so that one end 14*a* and the other end 14*a* of the bundle of carbon fibers 14A constituting the contact element are connected to the tracks 30, 31, so as to come into vertical contact with the first pattern 30 and comes into vertical contact with the second pattern 31. In this embodiment, the bundle of carbon fibers 14A or the holding member 14 is impregnated with lubricant therein, as in the previous embodiment.

According to the sliding-type electric component including the sliding contact member 44 having the bundle of carbon fibers 14A as shown in FIG. 8, the first track 30, and the second track 31, similar effects to the case of the sliding-type electric components described in the above-described embodiment may be obtained.

Figure 9:
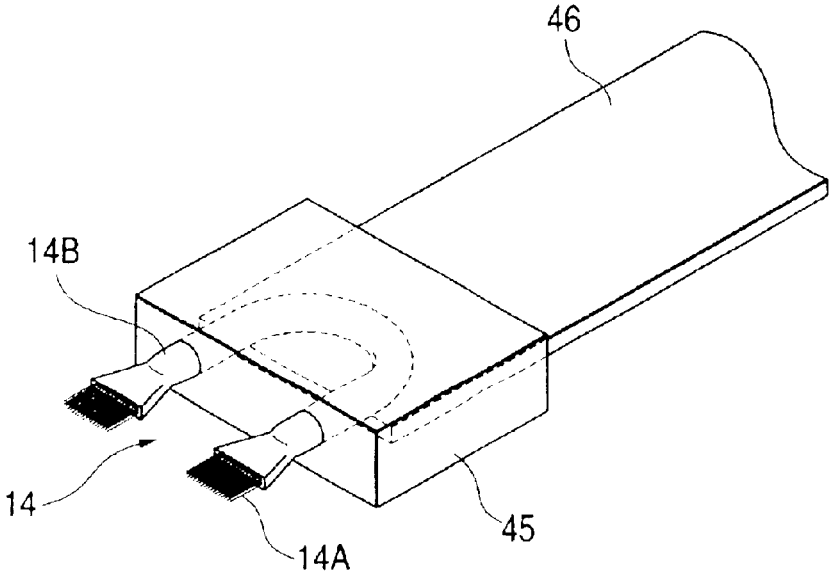
FIG. 9 is a perspective view showing another example of the mounting state of the sliding contact member according to a third embodiment of the invention.

FIG. 9 shows a third embodiment of the sliding contact member according to the invention. In this embodiment, the sliding contact member 14 including the bundle of carbon fibers 14A and the U-shape cylindrical holding member 14B for constraining the bundle of carbon fibers 14A, which is bent into a U-shape (bifurcated) as in the first embodiment, is mounted to a mounting body 46 having a resiliency, such as a leaf spring, via a joint layer 45 including an adhesive layer or an insert molded layer.

The construction according to this embodiment brings about the similar effects to those described above by mounting the mounting body 46 to the recess 15A of the sliding element support 15 in the first embodiment described above by fixing means such as adhesion.

In this embodiment, since the mounting body 46 has a resiliency by itself, the side portions 14*a* can easily be brought into resilient contact with the tracks 30, 31 without providing resiliency to the bundle of carbon fibers 14A.

Figure 10:
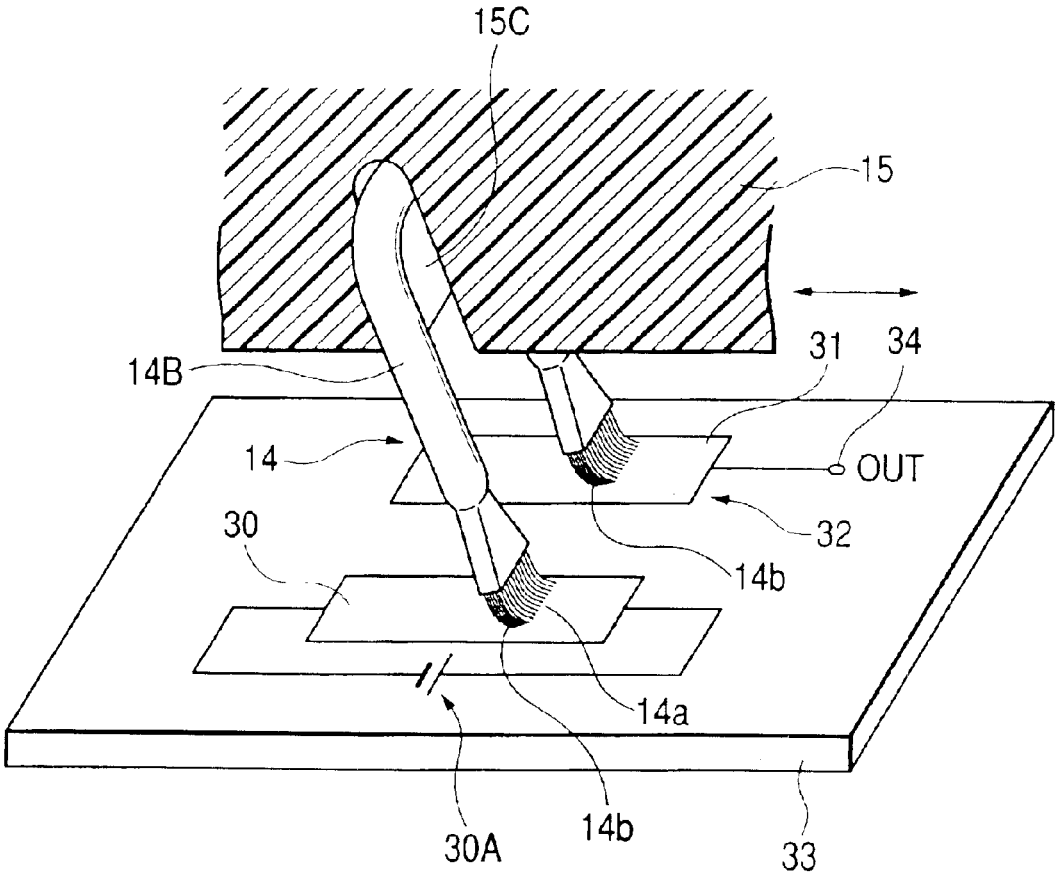
FIG. 10 is a perspective view of a sliding contact member according to a fourth embodiment of the invention.

FIG. 10 shows a fourth embodiment of the sliding contact member according to the invention. In FIG. 10, reference numeral 15 designates the sliding element support (supporting member) provided so as to be capable of lateral reciprocal movement in FIG. 1, and the sliding element support 15 is formed with a recess 15C diagonally extending on the bottom thereof, and the sliding contact member 14 is mounted to the recess 15C by fixing means such as adhesion or the like.

In this embodiment, the recess 15C is formed diagonally with respect to the tracks 30, 31 so as to allow the side portions 14*a* of the bundle of carbon fibers 14A to incline with respect to the tracks 30, 31. Though the angle of inclination ranges from about 20 to 60 degrees, for example, 30 degrees, it is not specifically limited to the above-described range.

Therefore, the sliding contact member 14, the first track 30, and the second track 31 constitute the sliding-type electric component, and the first track 30 and the bundle of carbon fibers 14A, and the second track 31 constitute the conducting route (electric path). In this electric path, the contact elements exist as sliding portions at the side portions 14*b*, 14*b* of the bundle of carbon fibers 14A. A predetermined direct current is applied on the first track 30 from a predetermined power unit 30A, and an output terminal 34 is formed at one end of the second track 31.

As is in this embodiment, the bundle of carbon fibers 14A may be slid diagonally with respect to the tracks 30, 31. In this case as well, a smooth sliding characteristic as in the previous embodiment may be achieved by employing lubricant impregnated in the bundle of carbon fibers 14A or lubricant contained in the holding member 14B.

Figure 11:
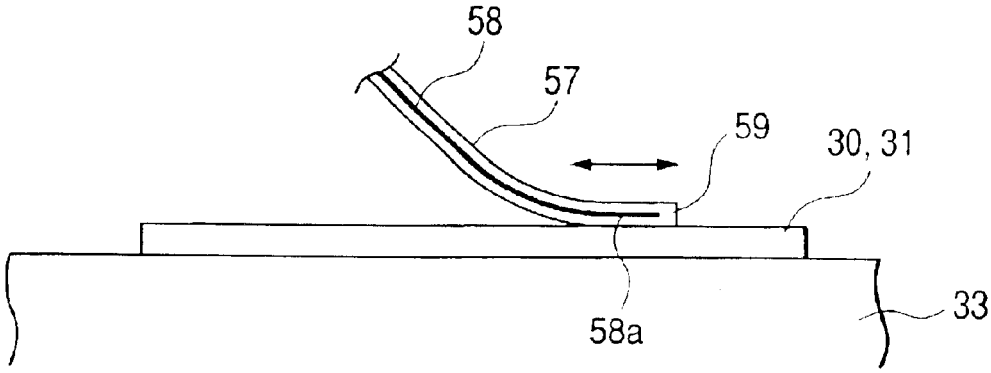
FIG. 11 is a perspective view of a sliding contact member according to a fifth embodiment of the invention.

FIG. 11 is an enlarged drawing showing a contact element obtained when the entire bundle of carbon fibers is covered by a layer of resin, and is an enlarged drawing showing that a contact element 57 in this embodiment includes a bundle of carbon fibers 58 and a covering layer 59 for covering the periphery thereof, and that the side portions 58*a* of the bundle of carbon fibers 58 is brought into abutment diagonally with the track 30 or 31 in close contact via the covering layer 59.

In the contact element 57 in this embodiment, a conductive carbon nanotube, a conductive material such as particles of conductive member, and lubricating particles are mixed in the covering layer 59 of resin.

In other words, when the bundle of carbon fibers 58 is cured with resin, it is preferable to mix conductive particles such as carbon black, conductive particles for reinforcing and improving sliding characteristics, such as carbon nanotube (in the order of 10 nm in diameter), and semi-solid lubricant such as grease or solid lubricant in advance in the resin liquid used.

In this embodiment, since the covering layer 59 of resin covers the periphery of the bundle of carbon fibers 58, rigidity of the bundle of carbon fibers 58 is enhanced by the covering layer 59, and is bridged by the portion covered by the covering layer 59. Therefore, when the bundle of carbon fibers 58 is reciprocally moved, the bundle of carbon fibers 58 can be moved reciprocally while maintaining the state shown in FIG. 11 without reversing the bent state and keeping the side portions 58*a* of the bundle of carbon fibers 58 in abutment with the track 30 even when the bundle of carbon fibers is moved inward and outward, that is, rightward and leftward along an arrow in FIG. 11.

In addition, since lubricant contained in the resin layer 59 exudes little by little to the contact portion as the covering layer 59 is worn gradually during the sliding movement, the sliding movement can be made smoothly.

Figure 12:
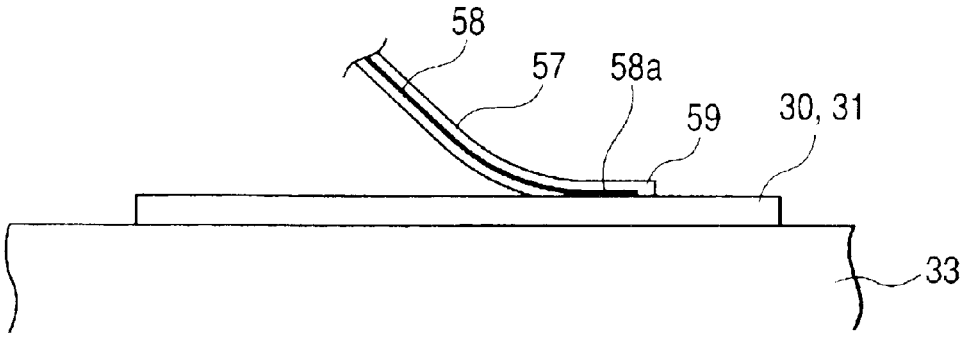
FIG. 12 is a cross-sectional view showing an example of the worn state of the sliding contact member according to the invention.

FIG. 12 shows a state in which the covering layer 59 of the contact element 57 provided with the bundle of carbon fibers 58 in the embodiment described above is worn due to repetitive sliding movements and is sliding while bringing the bundle of carbon fibers 58 into contact with the track 30.

In this state as well, if the contact element 57 as in the embodiment described above is employed, even when the covering layer 59 is worn, it just makes the bundle of carbon fibers 58 slide with respect to the track, and thus the object can be achieved while maintaining the sliding characteristics so as not to be specifically deteriorated. If the bundle of carbon fibers 58 impregnated with lubricant according to this embodiment is cured with the resin layer, even when the covering layer 59 is worn and thus part of the bundle of carbon fibers is brought into contact with the tracks 30, 31, the lubricant can be supplied from the peripheries of the carbon fibers to the contact portion so that the bundle of carbon fibers slides smoothly.

In the embodiment described above, it is more preferable to form the covering layer 59 with forming synthetic resin and to allow the lubricant to be contained in the gaps in the resin.

Figure 13:
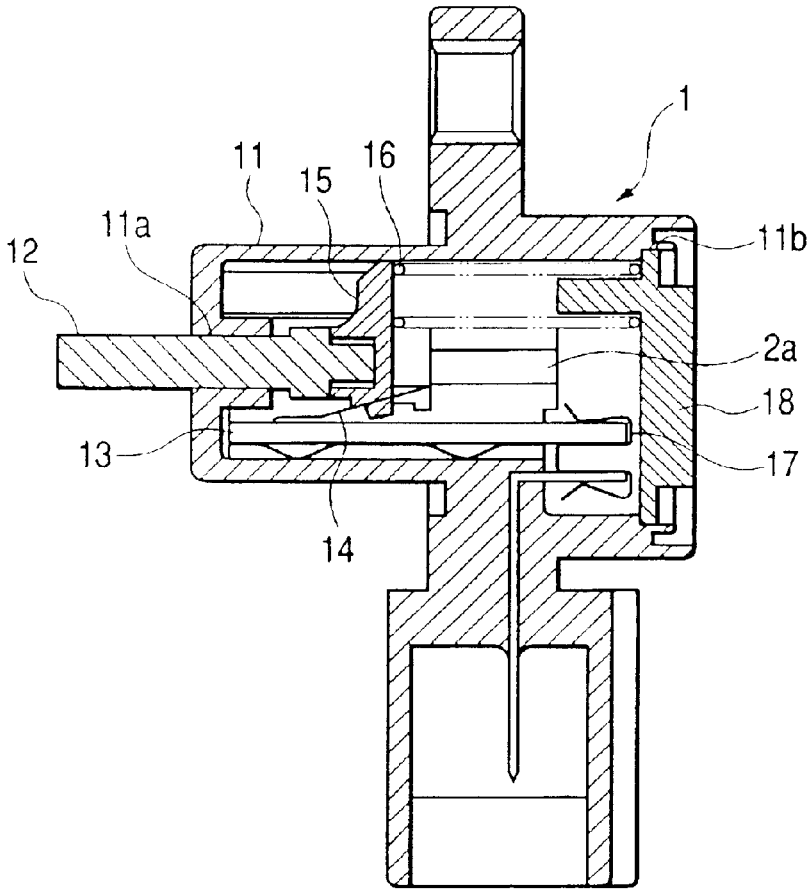
FIG. 13 is a cross-sectional view showing an example of a sensor provided with the sliding contact member according to the invention.
Figure 14:
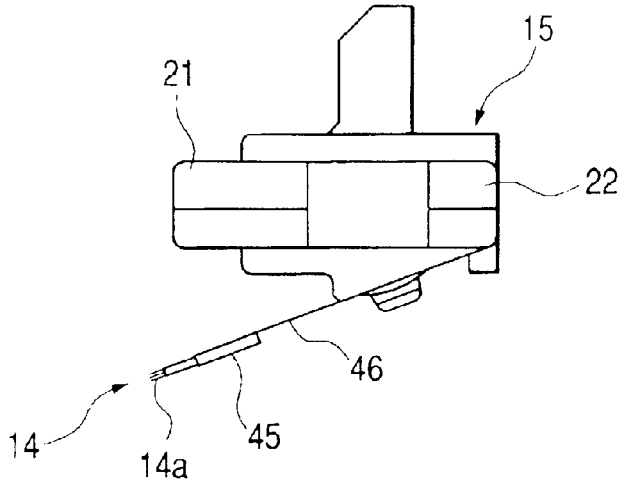
FIG. 14 is a side view showing part of the sensor shown in FIG. 13.
Figure 15:
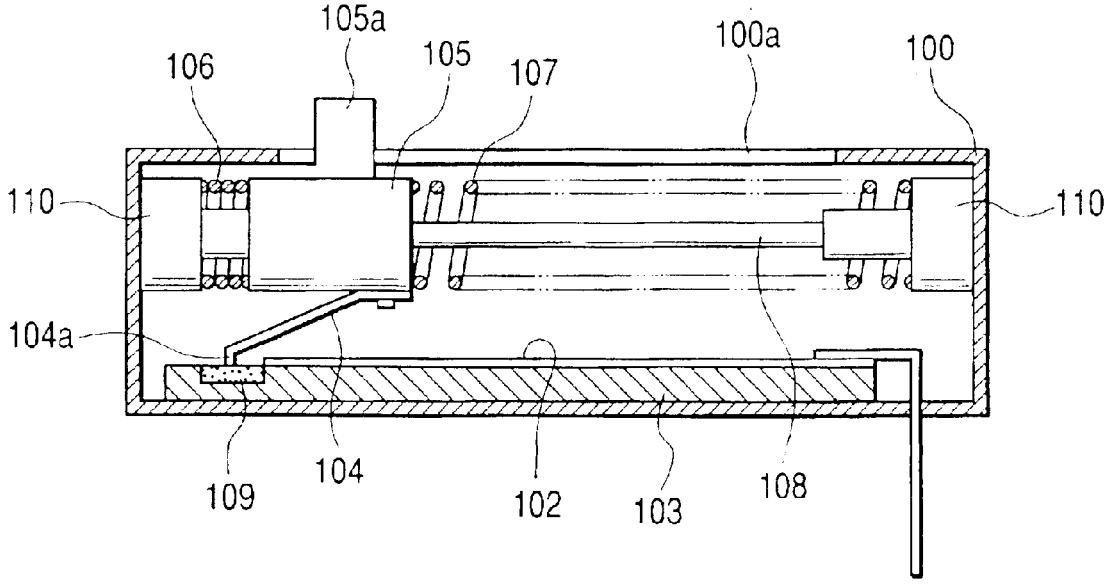
FIG. 15 PRIOR ART
FIG. 15 is a drawing showing an example of the sliding contact member in the relate art.

FIG. 13 and FIG. 14 show an example of a sensor for an automotive vehicle having the sliding contact member according to the invention. A sensor 1 in this embodiment is mounted on the automotive vehicle in the vicinity of the engine, and is used as a sensor for controlling an air-fuel ratio or as a sensor for controlling the recycling amount of exhausted gas. FIG. 13 shows a cross-sectional view of the sensor, and FIG. 14 is a side view showing a state in which the sliding contact member is mounted to the sliding element support.

The sensor 1 shown in FIG. 13 includes a casing 11 forming the outer shell, a shaft 12 being shiftable in the lateral direction in FIG. 1 with respect to the casing 11, a base member 13 integrated in the casing 11, the sliding contact member 14 being in sliding contact with the base member 13 including the first track 30 formed of a resistive element formed on the base member 13 and the second track 31 formed of a conductive element, the sliding element support (supporting member) 15 for holding the sliding contact member 14, and an external terminal 17 connected to the base member 13.

In the casing 11, the shaft 12 is inserted into a shaft hole 11*a* formed on one end (left end in FIG. 1), and a cover 18 is mounted to an opening 11*b* formed on the other end (right end in FIG. 1).

The sensor 1 of the construction described above is used in the vicinity of the engine in an automotive vehicle. The sensor 1 described above, which includes the sliding contact member 14 sliding reciprocally with respect to the base member 13 having the first track 30 and the second track 31, and detects the position of the shaft 12 having the sliding contact member 14 by measuring the electric resistance, in other words, the value of contact resistance, by a circuit connected to the bundle of carbon fibers 14A of the sliding contact member 14, the first track 30, and the second track 31 according to the position of the sliding contact member 14 during the sliding movement, serves as a position detecting sensor as in the case of the first embodiment.

The sensor 1, having the construction described above, detects the positions of the ends 14*a*, 14*a* of the bundle of carbon fibers 14A in the linear reciprocating movement. When the sensor 1 constitutes a rotating angle sensor, an annular first track and an annular second track having different diameters are disposed, for example, concentrically on the upper surface of a disk-shaped base member, the bundle of carbon fibers 14 as a contact element is mounted to a disk-shaped rotatable sliding element support and is disposed so as to straddle the annular first track and the annular second track, so that the contact positions of the ends 14*a* of the bundle of carbon fibers 14 with respect to the tracks varies in accordance with the rotating angle position of the rotating sliding element support. Therefore, the invention can also be applied to the rotating angle sensor that detects rotating angle based on the output voltage supplied in conjunction with the position as a matter of course.

The sliding contact member according to the invention is not limited to the resistive element for a sliding movement for the sensor of the automotive vehicle. As a matter of course, it may be applied to various usages as a sensor in a broad sense, such as a sliding resistor for adjusting slidac resistance of acoustical instrument (a sensor for adjustment), a switch (an input sensor), or a rotary encoder (an angular sensor).

In the example described above, the metal pipe, the resin pipe, or adhesive agent is used as the holding member for constraining the bundle of carbon fibers while maintaining the shape thereof. However, means for maintaining the shape of the bundle of carbon fibers may be a holding member formed by bending a channel material of angular C-shape in cross section, or a holding member having a composite structure formed by disposing a bent metal core material for holding the shape in a heat-shrinkable tubing. What is important is that the holding member has a capability to hold the bundle of carbon fibers into a predetermined shape, and the construction and material may be selected arbitrarily. Therefore, when the lubricant is contained in the above-described holding member, it should be contained in a channel material, a heat-shrinkable tubing, or the like. Although the lubricant is impregnated or stuffed directly in the carbon fibers or in the holding member in the examples described thus far, it is also possible to apply it on the resistive element in advance so that it is held among the carbon fibers in association with the sliding movement of the sliding contact member.

On the other hand, the ends 14*a* of the bundle of carbon fibers 14A do not have to be brought into direct contact with the tracks 30, 31, and it is also possible to cover the tracks 30, 31 with conductive layers and allow the bundle of carbon fibers 14 to slide thereon through the intermediary of the conductive layers. Alternatively, it is also possible to coat the end 14*a* of individual carbon fiber or of the bundle of carbon fibers 14A with a resin layer containing conductive particles.

In the embodiments described above, the pair of patterns 30, 31 are constructed of a combination of the layer of conductive element and the layer of resistive element. However, the construction in which both of the patterns include the layers of resistive element, the construction in which the both of the patterns include the layers of the conductive element, and the construction in which one track includes a comb-shaped conductive pattern and the other track includes a pattern of a collector are also applicable.

In addition, the bundle of carbon fibers that corresponds to the contact element described above is not limited to those in which the carbon fibers are supported by the embracing member, and may also be achieved by cloth formed by knitting carbon fibers, felt, or woven fabric.

In such a case, and in each embodiment, the pair of pattern may be constructed in such a manner that a current is input into one pattern and output from the other pattern via the sliding contact member, as a matter of course.

As described thus far, according to the invention, since lubricant is contained among the carbon fibers of the bundle of the carbon fibers, which corresponds to the contact element, the lubricant is automatically supplied to the sliding portion of the bundle of carbon fibers, which slides with respect to the separate member.

Since the bundle of carbon fibers slides with respect to the track of the conductive pattern while supplying lubricant according to the invention, possibility to grind the track is reduced in comparison with a case in which the carbon fibers are simply slid, and thus the track is hardly ground, thereby slowing progress of wear of the track. Therefore, when the track is subjected to the repetitive reciprocating sliding movement, sliding characteristic of the contact element with respect to the track becomes stable, and thus withstanding long term of use.

Since the bundle of carbon fibers according to the invention is held in the close contact state by the embracing member, lubricant can be contained easily in the gaps among the carbon fibers. Even when the lubricant is liquid such as lubricating oil, when the carbon fibers of the bundle of the carbon fibers are closely bundled, the lubricant can be held sufficiently by surface tension, and thus it can be held among the carbon fibers without problem even when the lubricant is grease or the like.

According to the invention, since the embracing member is formed of metallic material formed so as to clamp at least part of the bundle of carbon fibers, the effect to bring the carbon fibers into close contact with each other is ensured, and thus close contact support is ensured. Therefore, the effect to allow the embracing member to hold the lubricant may be enhanced, and thus supply of lubricant during the sliding movement is ensured.

What is claimed is:

1. An electric component comprising:

a pair of conductive tracks;

a tubular substantially U-shaped holder;

a bundle of carbon fibers carried by the substantially U-shaped holder such that the bundle of fibers is exposed at opposite ends of the holder, each end of the bundle of carbon fibers being arranged to diagonally engage an associated one of the conductive tracks at an angle of inclination in the range of approximately 20 to 60 degrees such that side portions of at least some of the carbon fibers in the bundle of carbon fibers resiliently brush against their associated conductive tracks, the bundle of carbon fibers being arranged to slide back and forth relative to the conductive tracks with the bundle of carbon fibers diagonally engaging the conductive tracks without reversing the orientation of the carbon fibers as the bundle of carbon fibers slides back and forth relative to the conductive tracks; and a lubricant contained among the bundle of carbon fibers.

2. An electric component as recited in claim 1 wherein the electric component is a variable resister.

3. An electric component as recited in claim 1 wherein the lubricant is contained within the substantially U-shaped holder.

4. An electric component as recited in claim 1 wherein the lubricant is impregnated within the bundle of carbon fibers.

5. An electric component as recited in claim 1 wherein the lubricant is carried in a resin that covers the carbon fibers.

6. An electric component as recited in claim 1 wherein the electric component is a component of a variable resister.

* * * * *